US009523054B2

(12) United States Patent
Pinappu et al.

(10) Patent No.: US 9,523,054 B2
(45) Date of Patent: Dec. 20, 2016

(54) ASPHALTENE STABILIZATION IN PETROLEUM FEEDSTOCKS BY BLENDING WITH BIOLOGICAL SOURCE OIL AND/OR CHEMICAL ADDITIVE

(71) Applicant: Baker Hughes Incorporated, Houston, TX (US)

(72) Inventors: Sai Reddy Pinappu, Houston, TX (US); Lawrence N. Kremer, The Woodlands, TX (US); Corina L. Sandu, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 181 days.

(21) Appl. No.: 14/464,210

(22) Filed: Aug. 20, 2014

(65) Prior Publication Data

US 2015/0052802 A1 Feb. 26, 2015

Related U.S. Application Data

(60) Provisional application No. 61/868,306, filed on Aug. 21, 2013.

(51) Int. Cl.

| | |
|---|---|
| ***C10L 1/18*** | (2006.01) |
| ***C10L 1/183*** | (2006.01) |
| ***C10L 1/24*** | (2006.01) |
| ***C10L 1/14*** | (2006.01) |
| ***C10L 1/16*** | (2006.01) |
| ***C10L 1/198*** | (2006.01) |
| ***C10L 10/18*** | (2006.01) |

(52) U.S. Cl.

CPC ..... *C10L 1/1802* (2013.01); *C10L 1/14* (2013.01); *C10L 1/143* (2013.01); *C10L 1/1608* (2013.01); *C10L 1/18* (2013.01); *C10L 1/1832* (2013.01); *C10L 1/1981* (2013.01); *C10L 1/24* (2013.01); *C10L 1/2475* (2013.01); *C10L 1/2493* (2013.01); *C10L 10/18* (2013.01)

(58) Field of Classification Search

CPC ..... C10L 1/1802; C09K 8/524
USPC ..... 507/90
See application file for complete search history.

(56) References Cited

U.S. PATENT DOCUMENTS

| | | | | |
|---|---|---|---|---|
| 7,795,183 | B2 * | 9/2010 | Wilkes | C09K 8/524 507/90 |
| 8,075,763 | B2 * | 12/2011 | Sneddon | C08L 61/06 208/179 |
| 8,123,930 | B2 * | 2/2012 | Cohrs | B01D 17/047 208/18 |

(Continued)

*Primary Examiner* — Ellen McAvoy

(74) *Attorney, Agent, or Firm* — Mossman, Kumar & Tyler, P.C.

(57) ABSTRACT

Biological source oils, including, but not limited to, algae oil, stabilize the presence of asphaltenes in petroleum feedstocks, such as crude oil, to help avoid or prevent problematic issues caused by the asphaltenes, such as sludges, plugging, deposits, fouling and/or corrosion in the production, transferring and processing of the petroleum feedstocks. Chemical additives such as phenol-based resins, and reaction products or combinations of long chain alpha-olefins and/or small chain aldehydes and/or long chain alkyl phenate sulfides and/or metal oxide-based colloidal hydrocarbon-based nanodispersions, may also stabilize the presence of asphaltenes in petroleum feedstocks. By "stabilizing" is meant keeping the asphaltenes in solution in the petroleum feedstocks.

17 Claims, 2 Drawing Sheets

(56) References Cited

U.S. PATENT DOCUMENTS

| | | | | |
|---|---|---|---|---|
| 9,045,676 | B2 * | 6/2015 | Gonzalez Davila | C09K 8/524 |
| 9,255,043 | B2 * | 2/2016 | Ovalles | C07C 7/20 |
| 2005/0091915 | A1 * | 5/2005 | Behler | C08G 61/00 44/435 |
| 2010/0065275 | A1 * | 3/2010 | McGowen | E21B 37/06 166/304 |
| 2011/0072715 | A1 * | 3/2011 | Hanks | C10G 3/50 44/389 |
| 2013/0124106 | A1 * | 5/2013 | Rogel | G01N 33/2823 702/25 |
| 2013/0310492 | A1 * | 11/2013 | Morgan | C04B 26/26 524/59 |
| 2014/0130581 | A1 * | 5/2014 | Ovalles | C09K 8/04 73/61.55 |
| 2014/0249338 | A1 * | 9/2014 | Roussis | A23D 9/00 585/24 |
| 2016/0046855 | A1 * | 2/2016 | Mastrangelo | C09K 8/524 585/4 |
| 2016/0090524 | A1 * | 3/2016 | Mastrangelo | C10L 1/2691 507/219 |

* cited by examiner

ASPHALTENE STABILIZATION IN PETROLEUM FEEDSTOCKS BY BLENDING WITH BIOLOGICAL SOURCE OIL AND/OR CHEMICAL ADDITIVE

CROSS-REFERENCE TO RELATED APPLICATION

This application claims the benefit of U.S. Provisional Patent Application No. 61/868,306 filed Aug. 21, 2013, incorporated herein by reference in its entirety.

TECHNICAL FIELD

The present invention relates to methods for stabilizing asphaltenes in petroleum feedstocks, and more particularly relates to methods for stabilizing asphaltenes in petroleum feedstocks by keeping them in solution through the addition of an effective amount of a biological source oil and/or an effective amount of a chemical additive.

BACKGROUND

Many fluids from subterranean formations, such as petroleum feedstocks, contain a large number of components with a very complex composition. For the purposes herein, a formation fluid is the product from an oil well from the time it is produced until it is refined. Some of the potentially fouling-causing components present in a formation fluid, for example wax and asphaltenes, are liquid under ambient conditions, but may aggregate or deposit under lower temperatures and pressures. Additionally, blending feedstocks of different compositions which are incompatible may also make asphaltenes come out of solution and cause problems; in a non-limiting instance such as when heavy Canadian crude oil is blended with shale oil. Waxes comprise predominantly high molecular weight paraffinic hydrocarbons, i.e. alkanes. Asphaltenes are typically dark brown to black-colored amorphous solids with complex structures and relatively high molecular weight and varying degrees of polarity depending on their origin compared to other crude oil components.

In addition to carbon and hydrogen in the composition, asphaltenes also may contain nitrogen, oxygen and sulfur species, as well as metals including, but not necessarily limited to vanadium, nickel, etc. Typical asphaltenes are known to have different solubilities in the formation fluid itself or in certain solvents like carbon disulfide, but are insoluble in solvents like light paraffinics, such as but not including pentane, heptane, etc.

For example, asphaltenes are most commonly defined as that soluble class of materials of crude oil, which is insoluble in heptane or pentane, but which is soluble in xylene and toluene. Asphaltenes exist in the form of colloidal dispersions stabilized by other components in the crude oil or other petroleum feedstock, and they may also exist as soluble species. They are the most polar fraction of crude oil, and often will be subjected to compositional and morphological changes and precipitate upon pressure changes, temperature changes, and indirect factors such as resulting from blending with another, incompatible crude oil, or other mechanical or physicochemical processing. Compositional changes include, but are not necessarily limited to, blending with different fluids such as other hydrocarbon mixtures, water, and other liquids that may adversely affect the solubility of asphaltenes in the resulting mixture.

As will be discussed in further detail, asphaltenes in petroleum feedstocks are known to cause issues like sludge, plugging deposits, fouling and corrosion in production, transferring and processing of the petroleum feedstocks, thereby increasing operating and maintenance costs of production. In one non-limiting embodiment, sludge refers to the residual, semi-solid material left or deposited or precipitated from the petroleum feedstocks.

Asphaltene precipitation occurs in pipelines, separators, valves, furnaces, heat exchangers and other equipment. Once formed and/or deposited, asphaltenes present numerous problems for crude oil producers. For example, asphaltene deposits can partially or completely plug or block downhole tubulars, well-bores, choke off pipes, pipelines, transfer lines or other conduits, valves and/or safety devices, and interfere with the functioning of separator equipment. These phenomena may result in shutdown, loss of production and risk of explosion or unintended release of hydrocarbons into the environment either on-land or off-shore.

In further detail, when the formation fluid from a subsurface formation, such as crude oil, comes into contact with a pipe, a valve, or other production equipment of a wellbore, or when there is a decrease in temperature, pressure, or change of other conditions, asphaltenes may precipitate or separate out of a well stream or the formation fluid while flowing into and through the wellbore to the wellhead. While any asphaltene separation or precipitation is undesirable in and by itself, it is much worse to allow the asphaltene precipitants to accumulate by sticking to the equipment in the wellbore. Any asphaltene precipitants sticking to the wellbore surfaces may narrow pipes; and clog wellbore perforations, various flow valves, and other well site and downhole locations. This may result in well site equipment failures. It may also slow down, reduce or even totally prevent the flow of formation fluid into the wellbore and/or out of the wellhead.

Similarly, undetected precipitations and accumulations of asphaltenes in a pipeline for transferring crude oil could result in loss of oil flow and/or equipment failure. Crude oil storage facilities could have maintenance or capacity problems if asphaltene precipitations occur. These fluids also carry unstable asphaltenes into the refinery, as well as possibly into finished fuels and products where the asphaltenes cause similar problems for facilities of this nature.

In general, when a petroleum feedstock or a hydrocarbon mixture has formed an additional phase with objectionable or problematic properties, the mixture may be characterized as "unstable" or as "demonstrating instability."

There are large incentives to mitigate fouling in refining. There are large costs associated with shutting down production units because of the fouling components within, as well as the cost to clean the units. Further, the asphaltenes may create an insulating effect within the production unit, and may reduce the efficiency and/or reactivity, and the like. In either case, reducing the amount of fouling-causing components would reduce the cost of hydrocarbon fluids and the products derived therefrom. Additional operational problems in refinery and other processing include, but are not necessarily limited to, fouling of heat exchangers and furnaces, increased tube skin temperatures of furnaces, increased unit upsets, increased pollution, loss of throughput, difficulty with desalting, increased load on wastewater plants, increased in air emissions, and reduced flexibility in plant operations, and the like.

Thus, it would be desirable to develop a method and composition for reducing the amount of fouling-causing components within a petroleum feedstock.

SUMMARY

There is provided, in one form, a method for stabilizing asphaltenes in a petroleum feedstock comprising adding to the petroleum feedstock containing asphaltenes an effective amount of a biological source oil to improve the stability of asphaltenes in the petroleum feedstock, where the biological source oil includes, but is not necessarily limited to, algae oils, vegetable oils, fish oils, animal oils and mixtures thereof.

Additionally there is provided a method for stabilizing asphaltenes in a petroleum feedstock that involves adding to the petroleum feedstock containing asphaltenes an effective amount of a chemical additive to improve the stability of asphaltenes in the petroleum feedstock. The chemical additive is selected from the group that includes, but is not necessarily limited to:

- alkylphenol-based resins, where the alkyl group is selected from the group consisting of octyl, nonyl, and dodecyl, and derivatives of these alkyl-phenol-based resins, where an alkylphenol is reacted with an aldehyde in the presence of a sulphonic acid,
- long chain alpha-olefins having more than 20 carbon atoms reacted with an aldehyde,
- long chain alkyl phenate sulfides having from 8 to 40 carbon atoms reacted with polyolefins,
- metal oxide-based colloidal hydrocarbon-based nanodispersions, and combinations of these.

By "nanodispersion" is meant that the metal oxide particles or organometallic particles are nanometer sized dispersed in the hydrocarbon, that is, ranging in size from about 1 nm to about 999 nm. For more information, please see U.S. Pat. No. 7,951,758 B2 to Baker Hughes Incorporated (Sandu, et al.) incorporated herein by reference in its entirety.

There is also provided in another non-restrictive version a method for stabilizing asphaltenes in a petroleum feedstock that involves adding to the petroleum feedstock an effective amount of a biological source oil and/or an effective amount of a chemical additive, both effective amounts to improve the stability of asphaltenes in the petroleum feedstock. The biological source oil and the chemical additive may be added alone or together or sequentially. Suitable biological source oils and chemical additives are those previously described. In a different non-limiting embodiment, when both a biological source oil and a chemical additive are introduced the asphaltenes are synergistically stabilized, which is defined as being stabilized in the petroleum feedstock to an extent that is greater than the additive of the stabilizing achieved with only the same amount of the biological source oil used separately, added to the stabilizing achieved with only the same amount of the chemical additive used separately.

There is further provided in another non-limiting embodiment a method for stabilizing asphaltenes in a petroleum feedstock that involves first evaluating the petroleum feedstock for asphaltene stability. When the petroleum feedstock exhibits asphaltene instability, the method additionally involves preparing a plurality of blends, where each blend has a different proportion ratio of the petroleum feedstock to a biological source oil and/or a chemical additive, where the biological source oil and/or a chemical additive and the petroleum feedstock are the same in each blend. Further the method includes evaluating each blend for asphaltene stability by selecting the blend that best improves the asphaltene stability of the petroleum feedstock in the blend.

DETAILED DESCRIPTION

Figure 1:
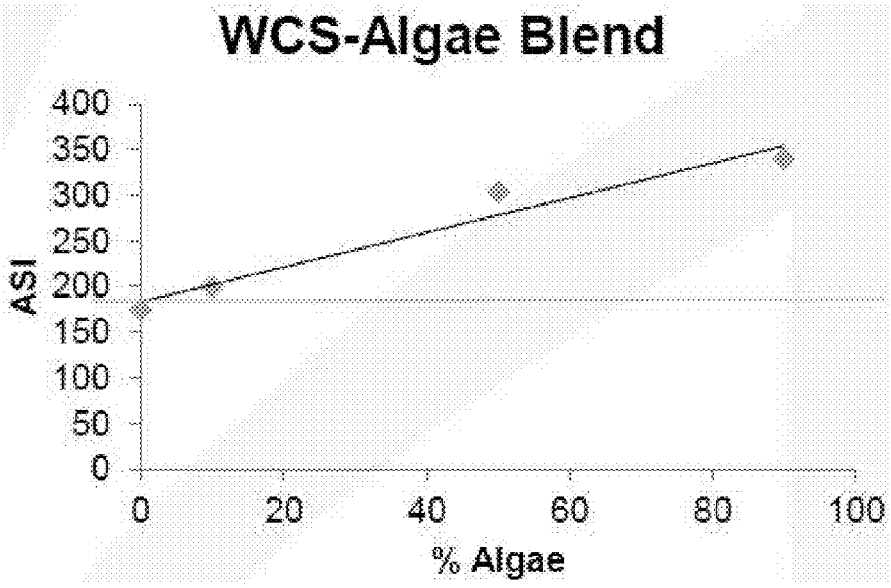
FIG. 1 is a graph of an Asphaltene Stability Index (ASI) as a function of the wt % amount of algae oil added to WCS crude oil.

It has been discovered that the asphaltenes in petroleum feedstocks may be stabilized by adding an effective amount of a biological source oil, including, but not necessarily limited to, algae oil, and/or a chemical additive to the petroleum feedstock.

The fouling-causing components may include asphaltenes. Other materials may cause fouling include, but are not necessarily limited to, solids particles, resins, organic acids, polymers, oxides, sulfides, metals, waxes, and combinations thereof. The methods of stabilizing asphaltenes may or may not stabilize these other materials and/or keep them from fouling as well.

It is typical to have petroleum feedstock blend in a tank that when added to a different petroleum feedstock blend in a different tank induces significant destabilization in the new blend or mixture. This destabilization may be controlled and avoided with proper selection of effective amounts of a biological source oil and/or a chemical additive.

"Inhibit" is defined herein to mean that the biological source oil and/or chemical additive may suppress or reduce the ability of the asphaltenes in the petroleum feedstocks to precipitate, flocculate or agglomerate in a problematic way if there are actually any asphaltenes present within the petroleum feedstocks. Without being limited to any particular explanation or mechanism, it is believed that this is accomplished by the asphaltenes remaining in solution in the petroleum feedstocks. "Prevent" is defined herein to mean entirely preventing any asphaltene precipitation, flocculation or agglomeration, or in other words, complete stability. However, it is not necessary for fouling to be entirely prevented for the methods and compositions discussed herein to be considered effective, although complete prevention and complete stabilization are desirable goals. All that is necessary is for asphaltenes to be more stabilized as compared with an identical petroleum feedstock absent the effective amount of the biological source oil, or absent the effective amount of the chemical additive, or both.

It is expected that the use of both a biological source oil and a chemical additive may have a synergistic effect. In one non-limiting embodiment, a synergistic effect is defined herein as when the asphaltenes are stabilized in the petroleum feedstock to an extent that is greater than the additive of (1) the stabilizing achieved with only the same amount of the biological source oil used separately, added to (2) the stabilizing achieved with only the same amount of the chemical additive used separately.

The asphaltenes may be stabilized in the petroleum feedstocks by one or more different mechanisms, such as but not limited to a stabilization mechanism, a dispersant mechanism, a radical inhibition mechanism, or combinations thereof.

The stabilization mechanism may be performed in a petroleum feedstock at a temperature ranging from about ambient and/or room temperature (defined herein as 22° C. (72° F.) independently to about 1000° C., or alternatively from about 200° C. independently to about 800° C. once the carbon-based biological source oil and/or chemical additive has been added to the base fluid. The effective amount of the biological source oil and/or the chemical additive added to the base fluid for the stabilization effect to occur, separately, considered individually or considered together, may range from about 0.01 to about 99 wt %; alternatively from about 1 independently to about 97 wt %, based on the petroleum feedstock. In other non-restrictive versions, the amount of biological source oil and/or the chemical additive may range from about 0.01 wt % independently to about 95 wt %, or alternatively from about 0.05 wt % independently to about 10 wt %, or 0.1 wt % independently to about 80 wt % or about 1 wt % independently to about 75 wt %; in another alternate embodiment from about 50 wt % to about 75 wt %. In a non-limiting instance, the amount of biological source oil and/or the chemical additive may range from about 5 wt % independently to about 80 wt %. "Independently" is defined herein to mean that any lower threshold may be used together with any upper threshold to give a suitable alternative range. An effective amount is defined herein as an amount added that inhibits or prevents the asphaltenes from agglomerating, precipitating or flocculating together.

In the low dosage regime of 1000 ppm (0.1 wt %) approximately the same asphaltene stabilizing effect is given by either the biological source oil or the chemical additive. At higher dosages of 5000 ppm (0.5 wt %) the biological source oil has been seen to provide greater asphaltene stability than that provided by chemical additives tried. As noted, by combining both the chemical additive and the biological source oil (combined 5000 ppm/0.5 wt %), for one particular combination the best effect on asphaltene stability improvement has been seen.

In one non-limiting embodiment the narrow dosage range of the chemical additive ranges from about 30 ppm to about 1-5 wt %.

It will be appreciated that the proportion of chemical additive and proportion of biological source oil when used in combination will vary regardless of their proportions when used separately. It is expected in one non-limiting embodiment that in most cases better stability will be achieved when both the chemical additive and the biological source oil are used in combination. The order of addition may be important; the chemical additive and/or biological source oil should be added to the petroleum feedstock, rather than adding the relatively heavier petroleum feedstock to either the additive or the biological source oil. In one non-limiting embodiment, the chemical additive, e.g. the alkylphenol-based resins, may have structures that have a dispersant effect and improve the stability with respect to asphaltenes by providing a resin "matrix" to support the asphaltenes within the feedstock media.

The petroleum feedstocks may include, but not necessarily be limited to, crude oils, heavy oils, coker feedstocks, visbreaker feedstocks, vacuum tower bottoms, fuel oils, diesel oils, bunker fuel oils (including, but not limited to, #6 oils), and the like and mixtures thereof. Petroleum feedstocks suitable herein include variations of those listed, including, but not necessarily limited to, "heavy crude oil", "heavy oil", "heavy fuel oil" and the like.

Temperature can be a factor in the method described herein only for resids (residual oil products that remain after petroleum has been distilled) or very viscous feeds; in general temperature of the petroleum feedstock is not expected to be a factor.

The biological source oils useful to improve the stability of asphaltenes in the petroleum feedstocks of the present method include, but are not necessarily limited to, algae oils, vegetable oils, fish oils, animal oils, cooking oils, biomass derived oils, biocrude and synthetically-produced oils, and mixtures thereof. It should be understood that "vegetable oils" is synonymous with "plant oils". Suitable vegetable oils include, but are not necessarily limited to, berry oils, flaxseed oils, hemp oils, pine oils, and the like. Also included are marine oils, which include egg oils, squid oils, krill oils, and the like.

Without being limited to any particular mechanism or explanation, it may be that organic fatty acids present in these biological source oil may help in stabilizing the asphaltenes. The petroleum feedstocks described herein as containing asphaltenes are also known to have high contents of acids, that is, high total acid number (TAN) values. One non-limiting organic fatty acid is omega-3 fatty acid. The organic fatty acids may stabilize asphaltene colloids, and/or may also dissolve asphaltenes on a molecular scale. Acid-base interactions may be responsible for the efficiency of these biological source oils in stabilizing asphaltenes. However, many details remain to be quantified regarding the action of any particular biological source oil on asphaltenes, including any effects of petroleum feedstock composition. For instance, resins are naturally amphiphilic components of petroleum fluids, which can associate with asphaltenes, but it is unknown whether they compete or cooperate with the biological source oil. In one non-limiting embodiment, a suitable biological source oil is algae oil. In another non-restrictive version, a suitable algae oil may be that supplied by SAPPHIRE ENERGY® Inc.

The chemical additives used herein may be one or more of a number of different types. In one non-limiting embodiment the chemical additive is an alkyl-phenol-based resin, where the alkyl group is selected from the group consisting of octyl, nonyl, and dodecyl. Suitable chemical additives also include derivatives of these alkylphenol-based resins where the alkylphenol is reacted with an aldehyde in the presence of a sulphonic acid, particularly of the dodecylbenzene sulfonic acid (DDBSA) type. Suitable aldehydes include, but are not necessarily limited to, formaldehyde, and the like. These additives may be used as described, or in conjunction with amines, including but not necessarily limited to mono-, di-, and tertiary amines, including, but not necessarily limited to, triethylenetetramine (TETA) and the like. One suitable, non-limiting chemical additive is a combination of phenol-based resins reacted with formaldehyde and TETA in the presence of DDBSA as a catalyst. Other suitable chemical additives include, but are not necessarily limited to, long chain alpha-olefins, where by the term "long chain" is meant having more than 20 carbon atoms, reacted with an aldehyde, including, but not necessarily limited to maleic anhydride and the like. Additional suitable chemical additives include, but are not necessarily limited to, long chain alkyl phenate sulfides, where the term "long chain alkyl" is defined as having from 8 to 40 carbon atoms, which phenate sulfides reacted with polyolefins; where suitable polyolefins are defined as phosphorous sulfide polyolefin. An additional group of suitable chemical additives include, but are not necessarily limited to, metal oxide-based colloidal hydrocarbon-based nanodispersions. Suitable metal oxide-based colloidal hydrocarbon-based nanodispersions include, but are not necessarily limited to, CaO, MgO, $Bi_2O_3$, $TiO_2$, and the like, where the nanosized metal oxides have average particle size of from about 1 independently to about 999 nm; alternatively from about 40 independently to about 200 nm. Any combination of these chemical additives may also be used.

In another non-limiting embodiment, the method for stabilizing asphaltenes in a petroleum feedstock involves a number of steps, including, but not necessarily limited to:

1. evaluating the petroleum feedstock for asphaltene stability;
2. when the petroleum feedstock exhibits asphaltene instability, preparing at least two blends, where each blend has a different proportion ratio of the petroleum feedstock to at least one biological source oil and/or at least one chemical additive, where the biological source oil is the same in each blend; and
3. evaluating each blend for asphaltene stability by selecting the blend that best improves the asphaltene stability of the petroleum feedstock in the blend.

Evaluating a petroleum feedstock for asphaltene stability may be performed using any of a number of known and proprietary evaluation and analytical methods, including, but not necessarily limited to, ASTM D7060 (Shell P-value method), ASTM D4312 (Toluene Equivalents Test), and ASTM D2781 (the Spot Test).

Preparing the blends is simply a matter of using different ratios of the same biological source oil in the same petroleum feedstock. At least a plurality of blends, that is, at least two blends should be used, but in other non-limiting embodiments, there may be at least three blends, at least four blends, at least five blends, at least six blends, at least seven blends, at least eight blends, at least nine blends, and at least ten blends.

Once the series of blends is prepared, and thoroughly and intimately mixed, each blend is evaluated for asphaltene stability using the same procedure as in the first evaluating, and then by selecting the blend that best improves the asphaltene stability of the petroleum feedstock in a particular blend, the optimum amount of biological source oil and/or optimum amount of chemical additive may be determined. Alternatively, this method may be used for specifying a minimum amount of algae oil (or other biological source oil) required to decrease process equipment fouling due to asphaltene destabilization. In other words, the optimum and/or minimum amount of biological source oil to make a stable blend can be determined. For example, if a hydrocarbon feedstock having an ASI of 100 is being processed and is giving issues with respect to fouling, then a minimum amount of algae oil can be specified to increase the ASI.

It will be appreciated that, as previously noted, petroleum feedstocks, such as crude oils, may vary widely in composition from one to another, and the biological source oil and/or chemical additive, and its proportion (or their proportion, if both are used), that is optimal for one petroleum feedstock may not be the type or amount of biological source oil and/or chemical additive optimal for a different petroleum feedstock. In one non-limiting embodiment, the selection and blend optimization method may be suitable done via direct measurement for each type of feed and blend.

The invention will now be described with respect to particular embodiments which are not intended to limit the invention in any way, but which are simply to further highlight or illustrate the invention. All percentages (%) are weight percentages unless otherwise noted.

EXAMPLES 1-4

Four different crude oils were blended with three different amounts of algae oil available from SAPPHIRE ENERGY: 10 wt %, 50 wt % and 90 wt %. Amounts of the crudes with no algae oil added were also evaluated. An Asphaltene Stability Index (ASI) for each was measured using a proprietary evaluation technique. The Examples, crudes and Figures where the results graphs are displayed are presented in Table I.

TABLE I

| Example | Crude Oil | Figure with graph |
|---|---|---|
| 1 | WCS | 1 |
| 2 | Suncor | 2 |
| 3 | WTI (West Texas Intermediate) | 3 |
| 4 | Petrobras | 4 |

Figure 2:
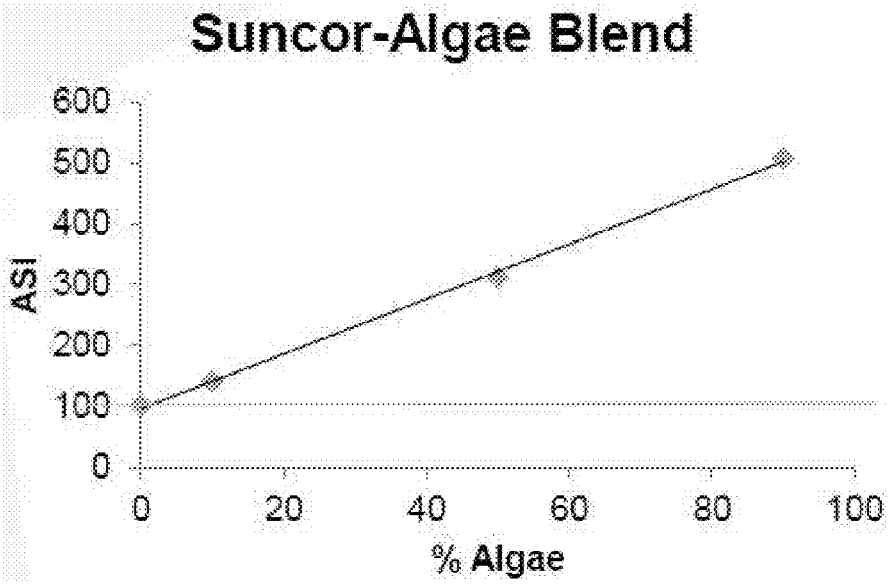
FIG. 2 is a graph of ASI as a function of the wt % amount of algae oil added to Suncor crude oil.
Figure 3:
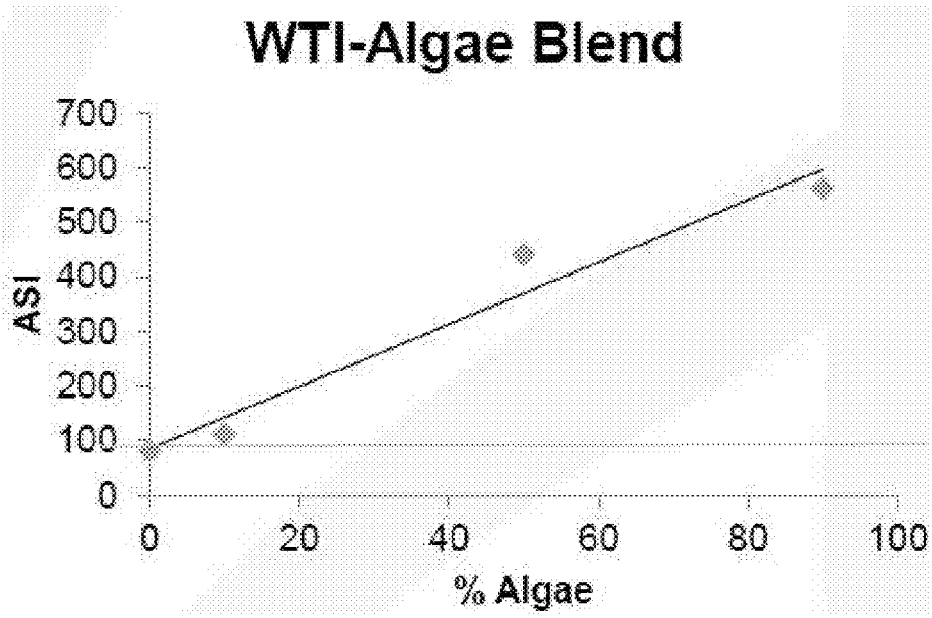
FIG. 3 is a graph of ASI as a function of the wt % amount of algae oil added to West Texas Intermediate (WTI) crude oil.
Figure 4:
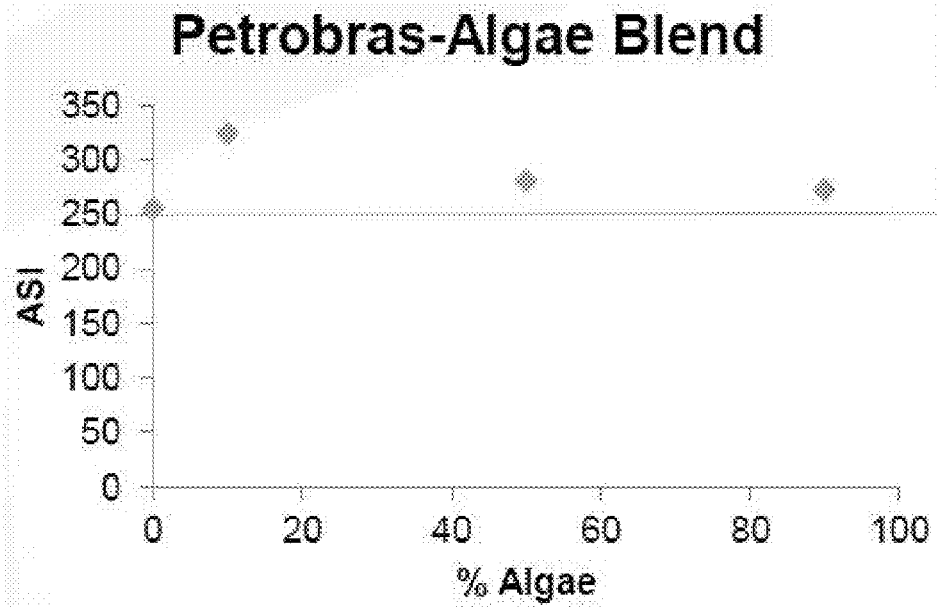
FIG. 4 is a graph of ASI as a function of the wt % amount of algae oil added to Petrobras crude oil.

In FIGS. 1, 2 and 3 for Examples 1, 2 and 3, respectively, it may be seen that asphaltene stability increases with increasing amounts of algae oil. However, in FIG. 4 for Example 4, the best asphaltene stability was achieved with 10 wt % algae oil. It may thus be seen that algae oil, a type of biological source oil, stabilizes the asphaltenes in each of four different petroleum feedstocks, i.e. crude oils, although at different optimum amounts.

EXAMPLES 5-23

Shown in Tables II and III are blends of WCS crude oil with Bakken shale oil having various amounts of algae oil and chemical additive, Additive 1. Additive 1 is a combination of alkylphenol-based resins where the alkyl group is octyl, nonyl, and dodecyl, reacted with formaldehyde in the presence of an amine such as TETA using DDBSA as a catalyst. The ASI or a visual observation is given for each.

TABLE II

WCS-Bakken Blend Testing with Algae Oil and Chemical Additive

| Ex. | % WCS | % Bakken | % Algae | Additive 1, ppm | ASI |
|---|---|---|---|---|---|
| 5 | 80 | 20 | 0 | 0 | 129.8 |
| 6 | 40 | 60 | 0 | 0 | 77.72 |
| 7 | 20 | 80 | 0 | 0 | 40.07 |
| 8 | 20 | 80 | 0 | 1000 | 44 |
| 9 | 20 | 80 | 0 | 5000 | 48.2 |
| 10 | 20 | 80 | 0 | 10000 | 52 |
| 11 | 20 | 80 | 0.01 | 5000 | 61 |
| 12 | 20 | 80 | 0.01 | 0 | 43.44 |
| 13 | 19 | 76 | 0.05 | 5000 | 89.7 |
| 14 | 19 | 76 | 0.05 | 0 | 74.6 |

TABLE III

WCS-Bakken Blend Testing with Algae Blends

| Ex. | % WCS | % Bakken | % Algae | Additive 1, ppm | ASI |
|---|---|---|---|---|---|
| 15 | 20 | 80 | 0 | 5000 | 48.3 |
| 16 | 16 | 64 | 20 | 5000 | 193 |
| 17 | 8 | 32 | 60 | 5000 | 819 |
| 18 | 80 | 80 | 0 | 0 | 40.07 |
| 19 | 96 | 64 | 20 | 0 | 192.3 |
| 20 | 20 | 60 | 20 | 5000 | 184.1 |

TABLE III-continued

| WCS-Bakken Blend Testing with Algae Blends | | | | | |
|---|---|---|---|---|---|
| Ex. | % WCS | % Bakken | % Algae | Additive 1, ppm | ASI |
| 21 | 20 | 60 | 20 | 0 | 184.3 |
| 22 | 20 | 40 | 40 | 5000 | No floc |
| 23 | 20 | 40 | 40 | 0 | No floc |

Examples 16 and 17 are examples of synergistic stability results using both algae oil and the chemical additive, Additive 1. Please also note that comparing Examples 20 and 15, it may be seen that replacing some of the conventional crude (Bakken) with algae oil in the presence of a chemical additive increases the asphaltene stability significantly. In these Examples, 40% of the Bakken was replaced by 20% algae oil and with other additive conditions being the same, the improvement in asphaltene stability was more than a 3.8× improvement (184.1/48.3).

In one non-limiting embodiment, biological source oil is presently difficult and expensive to produce in large quantities. It was discovered when using one or more chemical additives to reduce costs that there may be synergistic results when both of the one or more biological source oils are used together with the one or more chemical additive. Advantages of stabilizing the asphaltenes in a petroleum feedstock are that the quality of the feedstock, e.g. crude oil, is improved prior to its being shipped to a refinery. Further, such improved stability mitigates difficulties with the transport properties of the petroleum feedstock In the foregoing specification, the invention has been described with reference to specific embodiments thereof, and has been described as effective in providing methods and compositions for stabilizing asphaltenes in petroleum feedstocks such as crude oils. However, it will be evident that various modifications and changes can be made thereto without departing from the broader scope of the invention. Accordingly, the specification is to be regarded in an illustrative rather than a restrictive sense. For example, specific petroleum feedstocks, biological source oils, chemical additives, treatment conditions, and other components and procedures falling within the claimed parameters, but not specifically identified or tried in a particular method or composition, are expected to be within the scope of this invention.

The present invention may suitably comprise, consist or consist essentially of the elements disclosed and may be practiced in the absence of an element not disclosed. For instance, the method for stabilizing asphaltenes in a petroleum feedstock may consist essentially of or consist of adding to a petroleum feedstock containing asphaltenes an effective amount of at least one biological source oil and/or at least one chemical additive to improve the stability of asphaltenes in the petroleum feedstock, where the biological source oil is selected from the group consisting of algae oils, vegetable oils, fish oils, animal oils and mixtures thereof, and where the chemical additive is selected from the group consisting of:

alkylphenol-based resins, where the alkyl group is selected from the group consisting of octyl, nonyl, and dodecyl, and derivatives of these alkylphenol-based resins, where an alkylphenol is reacted with an aldehyde in the presence of a sulphonic acid, where the alkyl-phenol based resins are used alone or in conjunction with amines, long chain alpha-olefins having more than 20 carbon atoms reacted with an aldehyde, long chain alkyl phenate sulfides having from 8 to 40 carbon atoms reacted with polyolefins, metal oxide-based colloidal hydrocarbon-based nanodispersions, and combinations of these.

Alternatively, a method for stabilizing asphaltenes in a petroleum feedstock may consist essentially of or consist of:

evaluating the petroleum feedstock for asphaltene stability;

when the petroleum feedstock exhibits asphaltene instability, preparing at least two blends, where each blend has a different proportion ratio of the petroleum feedstock to at least one biological source oil and/or at least one chemical additive, where the at least one biological source oil and/or at least one chemical additive is the same in each blend; and evaluating each blend for asphaltene stability by selecting the blend that best improves the asphaltene stability of the petroleum feedstock in the blend.

The words "comprising" and "comprises" as used throughout, are to be interpreted to mean "including but not limited to" and "includes but not limited to", respectively.

What is claimed is:

1. A method for stabilizing asphaltenes in a petroleum feedstock comprising:

adding to the petroleum feedstock containing asphaltenes an effective amount to improve the stability of asphaltenes in the petroleum feedstock of:

at least one biological source oil, where the biological source oil is selected from the group consisting of algae oils, fish oils, krill oils, flaxseed oils, biocrude, and mixtures thereof; and at least one chemical additive to improve the stability of asphaltenes in the petroleum feedstock, where the chemical additive is selected from the group consisting of:

alkylphenol-based resins, where the alkyl group is selected from the group consisting of octyl, nonyl, and dodecyl, where an alkylphenol is reacted with an aldehyde in the presence of a sulphonic acid, where the alkyl-phenol based resins are used alone or in conjunction with amines, long chain alpha-olefins having more than 20 carbon atoms reacted with an aldehyde, long chain alkyl phenate sulfides having from 8 to 40 carbon atoms reacted with polyolefins, metal oxide-based colloidal hydrocarbon-based nanodispersions, and combinations of these chemical additives;

where the asphaltenes are synergistically stabilized in the petroleum feedstock which is defined as to an extent that is greater than the additive of:

the stabilizing achieved with only the same amount of the biological source oil used separately, added to the stabilizing achieved with only the same amount of the chemical additive used separately.

2. The method of claim 1 where the petroleum feedstock is selected from the group consisting of crude oils, heavy oils, coker feedstocks, visbreaker feedstocks, vacuum tower bottoms, fuel oils, diesel oils, bunker fuel oils, and mixtures thereof.

3. The method of claim 1 where the effective amount of biological source oil ranges from about 0.01 wt % to about 99 wt %, and the effective amount of the chemical additive ranges from about 0.05 wt % to about 99 wt %, both based on the amount of petroleum feedstock.

4. The method of claim 1 where the biological source oil is algae oil.

5. A method for stabilizing asphaltenes in a petroleum feedstock comprising:

evaluating the petroleum feedstock for asphaltene stability;

when the petroleum feedstock exhibits asphaltene instability, preparing a plurality of blends, where each blend has a different proportion ratio of the petroleum feedstock to at least one biological source oil and at least one chemical additive, where the biological source oil and a chemical additive is the same in each blend; and evaluating each blend for asphaltene stability by selecting the blend that best improves the asphaltene stability of the petroleum feedstock in the blend;

where the biological source oil is selected from the group consisting of algae oils, fish oils, krill oils, flaxseed oils, biocrude and mixtures thereof; and where the chemical additive is selected from the group consisting of:

alkylphenol-based resins, where the alkyl group is selected from the group consisting of octyl, nonyl, and dodecyl, where an alkylphenol is reacted with an aldehyde in the presence of a sulphonic acid, where the alkyl-phenol based resins are used alone or in conjunction with amines, long chain alpha-olefins having more than 20 carbon atoms reacted with an aldehyde, long chain alkyl phenate sulfides having from 8 to 40 carbon atoms reacted with polyolefins, metal oxide-based colloidal hydrocarbon-based nanodispersions.

6. The method of claim 5 where the method further comprises a method for specifying a minimum amount of biological source oil required to decrease process equipment fouling due to asphaltene destabilization.

7. The method of claim 5 where the petroleum feedstock is selected from the group consisting of crude oils, heavy oils, coker feedstocks, visbreaker feedstocks, vacuum tower bottoms, fuel oils, diesel oils, bunker fuel oils, and mixtures thereof.

8. The method of claim 5 where the amount of biological source oil and the amount of chemical additive in each blend ranges from about 0.01 wt % to about 99 wt %, based on the amount of petroleum feedstock.

9. The method of claim 5 where the blends comprise both a biological source oil and a chemical additive, and where the asphaltenes are synergistically stabilized in the petroleum feedstock which is defined as to an extent that is greater than the additive of:

the stabilizing achieved with only the same amount of the biological source oil used separately, added to the stabilizing achieved with only the same amount of the chemical additive used separately.

10. The method of claim 9 where:

the biological source oil is algae oil; and the at least one chemical additive is an alkylphenol-based resins, where the alkyl group is selected from the group consisting of octyl, nonyl, and dodecyl, and derivatives of these alkylphenol-based resins, where an alkylphenol is reacted with an aldehyde in the presence of a sulphonic acid, where the alkyl-phenol based resins are used in conjunction with triethylenetetramine (TETA).

11. A method for stabilizing asphaltenes in a petroleum feedstock comprising:

adding to the petroleum feedstock containing asphaltenes an effective amount to improve the stability of asphaltenes in the petroleum feedstock of:

at least one biological source oil that is an algae oil; and at least one chemical additive to improve the stability of asphaltenes in the petroleum feedstock, where the chemical additive is an alkylphenol-based resins, where the alkyl group is selected from the group consisting of octyl, nonyl, and dodecyl, where an alkylphenol is reacted with an aldehyde in the presence of a sulphonic acid, where the alkyl-phenol based resins are used alone or in conjunction with amines;

where the asphaltenes are synergistically stabilized in the petroleum feedstock which is defined as to an extent that is greater than the additive of:

the stabilizing achieved with only the same amount of the biological source oil used separately, added to the stabilizing achieved with only the same amount of the chemical additive used separately.

12. The method of claim 11 where the petroleum feedstock is selected from the group consisting of crude oils, heavy oils, coker feedstocks, visbreaker feedstocks, vacuum tower bottoms, fuel oils, diesel oils, bunker fuel oils, and mixtures thereof.

13. The method of claim 11 where the effective amount of biological source oil ranges from about 0.01 wt % to about 99 wt %, and the effective amount of the chemical additive ranges from about 0.05 wt % to about 99 wt %, both based on the amount of petroleum feedstock.

14. A method for stabilizing asphaltenes in a petroleum feedstock comprising:

adding to the petroleum feedstock containing asphaltenes an effective amount to improve the stability of asphaltenes in the petroleum feedstock of:

at least one biological source oil that is an algae oil; and at least one chemical additive to improve the stability of asphaltenes in the petroleum feedstock, where the chemical additive is an alkylphenol-based resins, where the alkyl group is selected from the group consisting of octyl, nonyl, and dodecyl, where an alkylphenol is reacted with an aldehyde in the presence of a sulphonic acid, where the alkyl-phenol based resins are used in conjunction with triethylenetetramine (TETA).

15. The method of claim 14 where the asphaltenes are synergistically stabilized in the petroleum feedstock which is defined as to an extent that is greater than the additive of:

the stabilizing achieved with only the same amount of the biological source oil used separately, added to the stabilizing achieved with only the same amount of the chemical additive used separately.

16. The method of claim 14 where the petroleum feedstock is selected from the group consisting of crude oils, heavy oils, coker feedstocks, visbreaker feedstocks, vacuum tower bottoms, fuel oils, diesel oils, bunker fuel oils, and mixtures thereof.

17. The method of claim 14 where the effective amount of biological source oil ranges from about 0.01 wt % to about 99 wt %, and the effective amount of the chemical additive ranges from about 0.05 wt % to about 99 wt %, both based on the amount of petroleum feedstock.

* * * * *